US010861635B2

(12) United States Patent
Matsunaga

(10) Patent No.: US 10,861,635 B2
(45) Date of Patent: Dec. 8, 2020

(54) ELECTRONIC COMPONENT

(71) Applicant: MURATA MANUFACTURING CO., LTD., Kyoto-fu (JP)

(72) Inventor: Minoru Matsunaga, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 239 days.

(21) Appl. No.: 15/258,223

(22) Filed: Sep. 7, 2016

(65) Prior Publication Data

US 2017/0092413 A1 Mar. 30, 2017

(30) Foreign Application Priority Data

Sep. 25, 2015 (JP) ..... 2015-188533

(51) Int. Cl.
*H01F 5/00* (2006.01)
*H01F 27/28* (2006.01)
(Continued)

(52) U.S. Cl.
CPC ..... *H01F 27/2804* (2013.01); *H01F 17/0013* (2013.01); *H01F 27/245* (2013.01); *H01F 27/29* (2013.01); *H01F 27/292* (2013.01); *H01F 27/40* (2013.01); *H01F 2017/0026* (2013.01); *H01F 2027/2809* (2013.01)

(58) Field of Classification Search
USPC ..... 336/200, 223, 232
See application file for complete search history.

(56) References Cited

U.S. PATENT DOCUMENTS 6,388,551 B2 * 5/2002 Morikawa ..... H01P 5/10 29/602.1
6,628,189 B2 * 9/2003 Yazaki ..... H01F 17/0013 333/25

(Continued)

FOREIGN PATENT DOCUMENTS

CN 1485863 A 3/2004
CN 104184430 A 12/2014

(Continued)

OTHER PUBLICATIONS

An Office Action; "Notification of Reasons for Rejection," issued by the Japanese Patent Office dated Apr. 24, 2018, which corresponds to Japanese Patent Application No. 2015-188533 and is related to U.S. Appl. No. 15/258,223.

(Continued)

*Primary Examiner* — Ronald Hinson
(74) *Attorney, Agent, or Firm* — Studebaker & Brackett PC

(57) ABSTRACT

An electronic component having a multilayer body that includes a plurality of insulating layers that are stacked on top of one another; a plurality of first coils that are arranged inside the multilayer body in a stacking direction of the multilayer body and are electrically connected to each other; a plurality of second coils that are arranged inside the multilayer body in the stacking direction of the multilayer body and are electrically connected to each other; an inner ground electrode that is provided inside the multilayer body and is arranged between two of the first coils, which face each other in the stacking direction; and a ground terminal that is connected to the inner ground electrode.

11 Claims, 17 Drawing Sheets

(51) Int. Cl.

| | |
|---|---|
| ***H01F 17/00*** | (2006.01) |
| ***H01F 27/29*** | (2006.01) |
| ***H01F 27/245*** | (2006.01) |
| ***H01F 27/40*** | (2006.01) |

(56) References Cited

U.S. PATENT DOCUMENTS

| | | | | |
|---|---|---|---|---|
| 2001/0040495 | A1 | 11/2001 | Morikawa | |
| 2004/0070468 | A1* | 4/2004 | Harada | H01P 1/20345 333/185 |
| 2004/0070768 | A1* | 4/2004 | McDaniel | G02B 26/001 356/519 |
| 2009/0121806 | A1* | 5/2009 | Sasaki | H03H 1/00 333/174 |
| 2014/0347773 | A1 | 11/2014 | Park et al. | |
| 2015/0170816 | A1 | 6/2015 | Liu et al. | |
| 2017/0294257 | A1 | 10/2017 | Omori et al. | |

FOREIGN PATENT DOCUMENTS

| | | | |
|---|---|---|---|
| CN | 204425289 | U | 6/2015 |
| JP | 2006-114801 | A | 4/2006 |
| JP | 2009-099930 | A | 5/2009 |
| JP | 2011-181512 | A | 9/2011 |
| JP | 2012-124470 | A | 6/2012 |
| JP | 2014-053765 | A | 3/2014 |
| JP | 2014-230278 | A | 12/2014 |
| JP | 2015-005628 | A | 1/2015 |
| JP | 2017-041492 | A | 2/2017 |
| KR | 2004-0018188 | A | 3/2004 |
| KR | 2015-0071676 | A | 6/2015 |

OTHER PUBLICATIONS

An Office Action; "Notification of Preliminary Rejection," issued by the Korean Patent Office dated Sep. 20, 2017, which corresponds to Korean Patent Application No. 10-2016-0116473 and is related to U.S. Appl. No. 15/258,223; with English language translation.

An Office Action issued by the State Intellectual Property Office of the People's Republic of China dated Apr. 15, 2020, which corresponds to Chinese Patent Application No. 201610833929.1 and is related to U.S. Appl. No. 15/258,223. with English language translation.

* cited by examiner

ELECTRONIC COMPONENT

CROSS REFERENCE TO RELATED APPLICATIONS

This application claims benefit of priority to Japanese Patent Application 2015-188533 filed Sep. 25, 2015, the entire content of which is incorporated herein by reference.

TECHNICAL FIELD

The present disclosure relates to an electronic component that includes a common mode choke coil and a capacitor.

BACKGROUND

An electronic component disclosed in Japanese Unexamined Patent Application Publication No. 2014-53765 and an electronic component disclosed in Japanese Unexamined Patent Application Publication No. 2014-230278 are examples of electronic components of the related art.

In the electronic component disclosed in Japanese Unexamined Patent Application Publication No. 2014-53765, first and second capacitor electrodes are provided parallel to each other above first and second coils that form a common mode filter. Third and fourth capacitor electrodes are provided parallel to each other below the first and second coils. The first capacitor electrode is connected to one end of the first coil and the third capacitor electrode is connected to the other end of the first coil. The second capacitor electrode is connected to one end of the second coil and the fourth capacitor electrode is connected to the other end of the second coil.

A first ground electrode is provided above the first and second capacitor electrodes. A second ground electrode is provided below the third and fourth capacitor electrodes. Capacitances are generated between the first capacitor electrode and the first ground electrode and between the second capacitor electrode and the first ground electrode. Capacitances are generated between the third capacitor electrode and the second ground electrode and between the fourth capacitor electrode and the second ground electrode.

As illustrated in the equivalent circuit of FIG. 17, a first capacitor electrode 131 and a third capacitor electrode 133 are connected to the two ends of a first coil 121, and a first ground electrode 141 faces the first capacitor electrode 131 and the third capacitor electrode 133. A second capacitor electrode 132 and a fourth capacitor electrode 134 are connected to the two ends of a second coil 122, and a second ground electrode 142 faces the second capacitor electrode 132 and the fourth capacitor electrode 134. In other words, a so-called π-type LC filter structure is formed as an equivalent circuit.

On the other hand, the electronic component disclosed in Japanese Unexamined Patent Application Publication No. 2014-230278 has two first coils and two second coils that form a common mode filter. The two first coils are electrically connected to each other. The two second coils are electrically connected to each other. The coils are arranged in the order of one first coil, one second coil, the other first coil and the other second coil in a stacking direction. A ground electrode is provided between the one second coil and the other first coil and capacitances are generated between the ground electrode and the first and second coils.

However, when the above-described electronic components of the related art were manufactured and actually used, the following problems were discovered.

In the electronic component disclosed in Japanese Unexamined Patent Application Publication No. 2014-53765, since an π-type LC filter structure is adopted, it is necessary to have large capacitance values in order to realize LC resonance. Consequently, a signal transmission characteristic Sdd21 is poor and signal quality is degraded.

On the other hand, in the electronic component disclosed in Japanese Unexamined Patent Application Publication No. 2014-230278, a ground electrode is arranged between a first coil and a second coil and therefore, in the case where a differential mode signal flows in the first and second coils, magnetic flux generated by the first coil and magnetic flux generated by the second coil above and below the ground electrode flow in directions such that the magnetic fluxes cancel each other out at the ground electrode. However, loss occurs at the ground electrode and some magnetic flux remains due to the effect of this loss. An inductance and an impedance are generated in a differential mode due to this remaining magnetic flux. As a result, coupling between the first coil and the second coil is weakened and this leads to degradation of the signal transmission characteristic Sdd21.

SUMMARY

Accordingly, the present disclosure addresses the problem of providing an electronic component that can suppress reduction of signal quality by reducing degradation of a signal transmission characteristic.

In order to solve this problem, an electronic component of a preferred embodiment of the present disclosure includes: a multilayer body that includes a plurality of insulating layers that are stacked on top of one another; a plurality of first coils that are arranged inside the multilayer body in a stacking direction of the multilayer body and are electrically connected to each other; a plurality of second coils that are arranged inside the multilayer body in the stacking direction of the multilayer body and are electrically connected to each other; an inner ground electrode that is provided inside the multilayer body and is arranged between two of the first coils that face each other in the stacking direction; and a ground terminal that is connected to the inner ground electrode.

In the electronic component of the preferred embodiment of the present disclosure, the inner ground electrode is arranged between two first coils, which face each other in the stacking direction. Consequently, capacitances are generated between the inner ground electrode and the first coils and the second coils and a so-called T-type LC filter structure is formed as an equivalent circuit. Therefore, resonance can be obtained with smaller capacitance values than in the π-type LC filter structure of the related art and a reduction in signal quality can be suppressed by reducing degradation of the signal transmission characteristic Sdd21.

Furthermore, since the inner ground electrode is arranged between the two first coils, which face each other in the stacking direction, coupling between the first coils and the second coils is strengthened compared with the case where the inner ground electrode is arranged between first coils and second coils, and reduction of signal quality can be suppressed by reducing degradation of the signal transmission characteristic Sdd21.

In addition, in a preferred embodiment of the electronic component, at least one of the second coils is arranged at at least one of an uppermost position and a lowermost position among the plurality of first and second coils in the stacking direction, and an outer ground electrode, which faces at least one of the second coils, is provided outside of at least one of the second coils in the stacking direction.

In this preferred embodiment, the outer ground electrode, which faces at least one of the second coils, is provided outside of at least one of the second coils in the stacking direction and therefore it is possible to match the value of a capacitance between the first coils and the ground and the value of a capacitance between the second coils and the ground with each other and the electrical characteristics are improved.

Furthermore, in a preferred embodiment of the electronic component, the second coils are arranged at both the uppermost position and the lowermost position among the plurality of first and second coils in the stacking direction, and the outer ground electrode is provided in a plurality and the outer ground electrodes are arranged outside both of the second coils.

In this preferred embodiment, the outer ground electrodes are arranged outside both of the second coils and therefore it is even easier to match the value of the capacitance between the first coils and the ground and the value of the capacitance between the second coils and the ground with each other and the electrical characteristics are further improved. In addition, since a vertically symmetrical chip structure is formed, balancing of contraction and stress generated when firing is performed can be achieved.

Furthermore, in a preferred embodiment of the electronic component, there are two of each of the first and second coils, and the two first coils are interposed between one of the second coils and another of the second coils.

In this preferred embodiment, the two first coils are interposed between the one second coil and the other second coil and therefore coupling between the first coils and second coils is strengthened.

In addition, in a preferred embodiment of the electronic component, the multilayer body includes a non-magnetic body and magnetic bodies that vertically sandwich the non-magnetic body therebetween in the stacking direction, the first and second coils are arranged inside the non-magnetic body, and the one or more outer ground electrodes are arranged inside the non-magnetic body.

In this preferred embodiment, the first and second coils and the one or more outer ground electrodes are arranged inside the non-magnetic body and the non-magnetic body is vertically sandwiched between the magnetic bodies and therefore magnetic flux of the first and second coils is concentrated in the magnetic bodies above and below the non-magnetic body. Therefore, magnetic flux that flows around the individual coils among first and second coils is reduced and shared magnetic flux that flows around the first and second coils is increased. Therefore, coupling between the first coils and the second coils can be strengthened and consequently degradation of the signal transmission characteristic Sdd21 can be further reduced.

In addition, in a preferred embodiment of the electronic component, the multilayer body includes a non-magnetic body and magnetic bodies that vertically sandwich the non-magnetic body therebetween in the stacking direction, the first and second coils are arranged inside the non-magnetic body, and the one or more outer ground electrodes are arranged inside the magnetic bodies.

In this preferred embodiment, the one or more outer ground electrodes are arranged inside the magnetic bodies and therefore the thickness of the non-magnetic layer can be reduced and the distance between the magnetic bodies above and below the non-magnetic body is decreased. Therefore, magnetic flux in the case where common mode noise flows is further strengthened. Therefore, the inductance and impedance for common mode noise become larger and the attenuation in a common mode noise attenuation characteristic Scc21 can be increased.

In addition, since the one or more outer ground electrodes are arranged inside the magnetic bodies, the one or more outer ground electrodes can be arranged in magnetic bodies that are different bodies to the non-magnetic body in which the first and second coils are arranged, and an increase in stress in the non-magnetic body caused by the electrodes being concentrated in the non-magnetic body is relaxed and the occurrence of structural defects and a decrease in reliability can be suppressed.

Furthermore, in a preferred embodiment of the electronic component, a surface area of each of the one or more outer ground electrodes when looking in the stacking direction is larger than a surface area of the inner ground electrode when looking in the stacking direction.

In this preferred embodiment, the surface area of each of the one or more outer ground electrodes when looking in the stacking direction is larger than the surface area of the inner ground electrode when looking in the stacking direction and therefore even when the distance between the one or more outer ground electrodes inside the magnetic bodies and the second coils inside the non-magnetic body is larger than the distance between the inner ground electrode inside the non-magnetic body and the first coils inside the non-magnetic body, the value of the capacitance between the first coils and the ground and the value of the capacitance between the second coils and the ground are substantially the same and the electrical characteristics are improved.

Furthermore, in a preferred embodiment of the electronic component, the inner and outer ground electrodes are each formed in a substantially spiral shape, and a length of the spiral shape of each of the one or more outer ground electrodes is longer than a length of the spiral shape of the inner ground electrode.

According to this preferred embodiment, the length of the spiral shape of the one or more outer ground electrodes is longer than the length of the spiral shape of the inner ground electrode and therefore the surface area of each of the one or more outer ground electrodes when looking in the stacking direction can be made larger than the surface area of the inner ground electrode when looking in the stacking direction by using a simple configuration.

Furthermore, in a preferred embodiment of the electronic component, the inner ground electrode is superposed with the first coils, which face the inner ground electrode, and is not superposed with inner diameter parts of the first coils, which face the inner ground electrode, when viewed in the stacking direction, and the one or more outer ground electrodes are superposed with the second coils, which face the one or more outer ground electrodes, and are not superposed with inner diameter parts of the second coils, which face the one or more outer ground electrode, when viewed in the stacking direction.

According to this preferred embodiment, the inner ground electrode is not superposed with the inner diameter parts of the first coils, which face the inner ground electrode, when viewed in the stacking direction and the one or more outer ground electrodes are not superposed with inner diameter parts of the second coils, which face the one or more outer ground electrodes, when viewed in the stacking direction. As a result, magnetic flux of the first and second coils is not blocked by the inner and outer ground electrodes and degradation of characteristics due to the effect of loss of magnetic flux can be suppressed.

In addition, in a preferred embodiment of the electronic component, the inner ground electrode has a substantially spiral shape that has a line width and a line separation that are substantially the same as those of the first coils, which face the inner ground electrode, and is arranged at such a position as to be superposed with a pattern of the first coils when viewed in the stacking direction, and the one or more outer ground electrodes have a substantially spiral shape that has a line width and a line separation that are substantially the same as those of the second coils, which face the one or more outer ground electrodes, and are arranged at such a position as to be superposed with a pattern of the second coils when viewed in the stacking direction.

According to this preferred embodiment, the inner ground electrode has a similar pattern to the first coils, which face the inner ground electrode, when viewed in the stacking direction and the one or more outer ground electrodes have a similar pattern to the second coils, which face the one or more outer ground electrodes, when viewed in the stacking direction. Consequently, the surface areas of the inner and outer ground electrodes can be reduced to the minimum and the capacitances can be efficiently obtained. In addition, since the surface areas of the inner and outer ground electrodes when looking in the stacking direction, can be made small, the generation of stress caused by differences between the coefficients of linear expansion of the inner and outer ground electrodes and the multilayer body can be reduced.

Furthermore, in a preferred embodiment of the electronic component, the electronic component further includes an electrostatic discharge element that is provided in the multilayer body, is connected to the first and second coils and is connected to the ground terminal.

According to this preferred embodiment, since the electronic component further includes an electrostatic discharge element, countermeasures against static electricity can be taken for the first and second coils.

Other features, elements, characteristics and advantages of the present disclosure will become more apparent from the following detailed description of preferred embodiments of the present disclosure with reference to the attached drawings.

DETAILED DESCRIPTION

Hereafter, the present disclosure will be described in detail using illustrative embodiments.

First Embodiment

Figure 1:
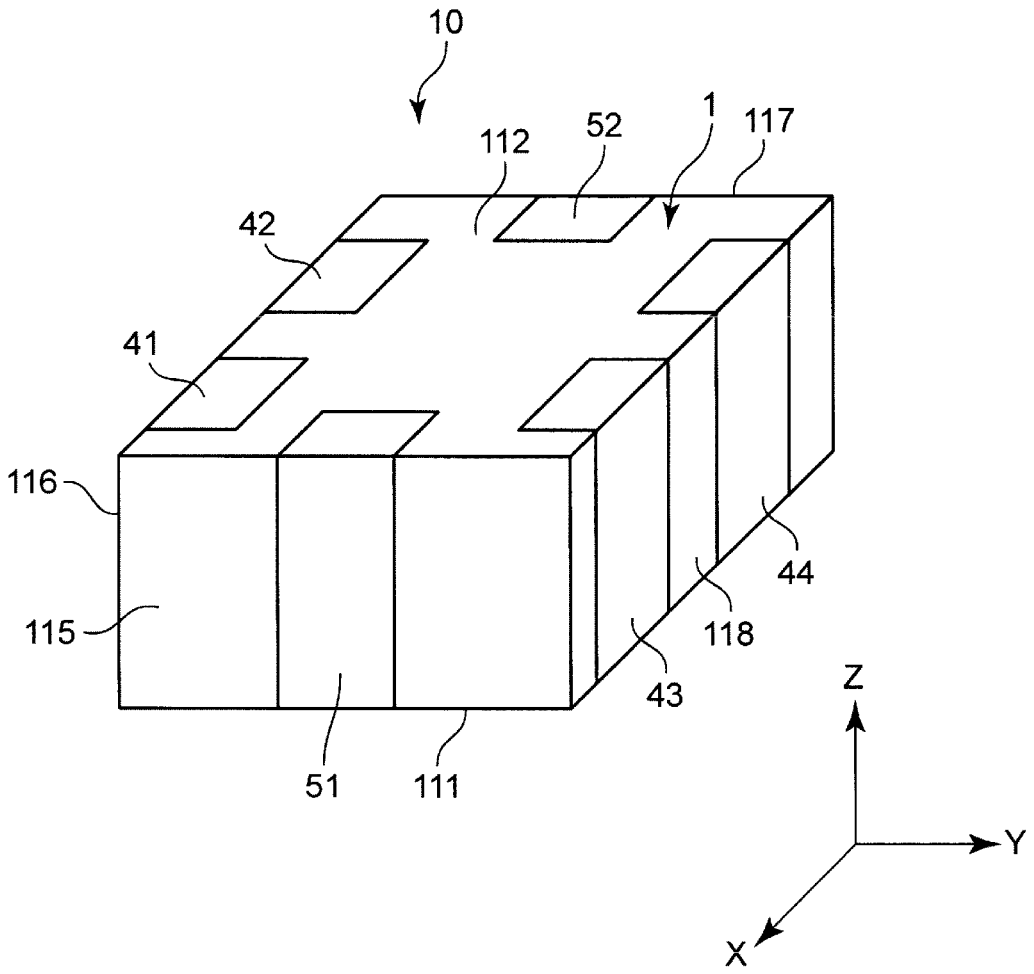
FIG. 1 is a perspective view illustrating an electronic component of a first embodiment of the present disclosure.
Figure 2:
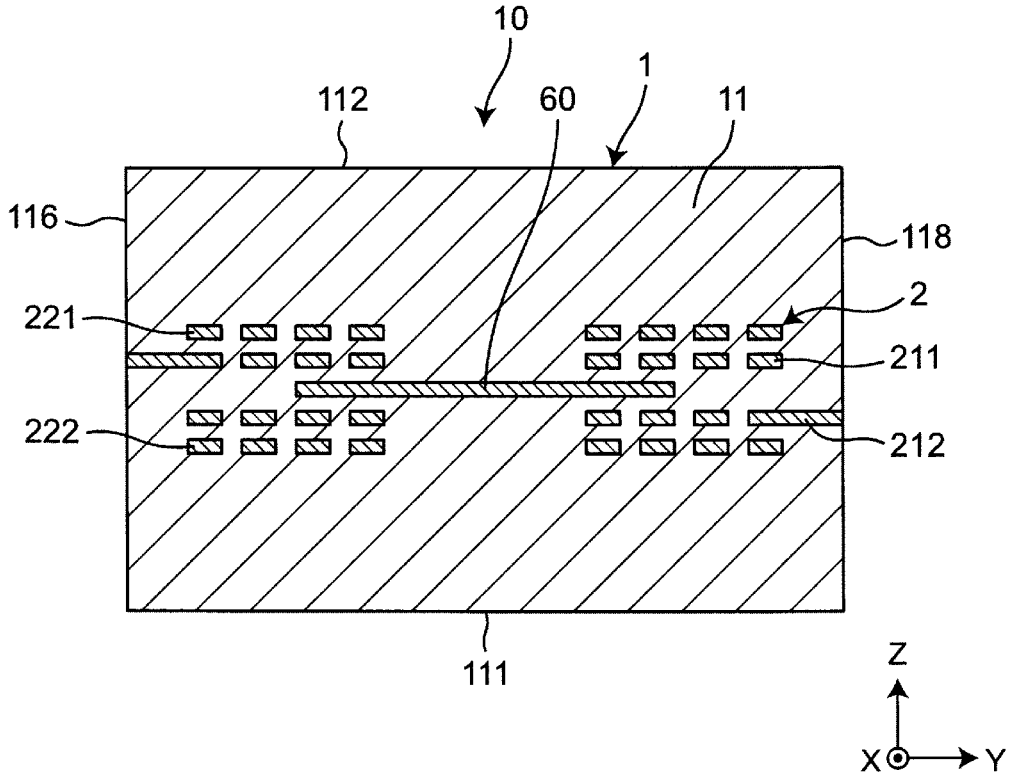
FIG. 2 is a YZ sectional view of the electronic component.
Figure 3:
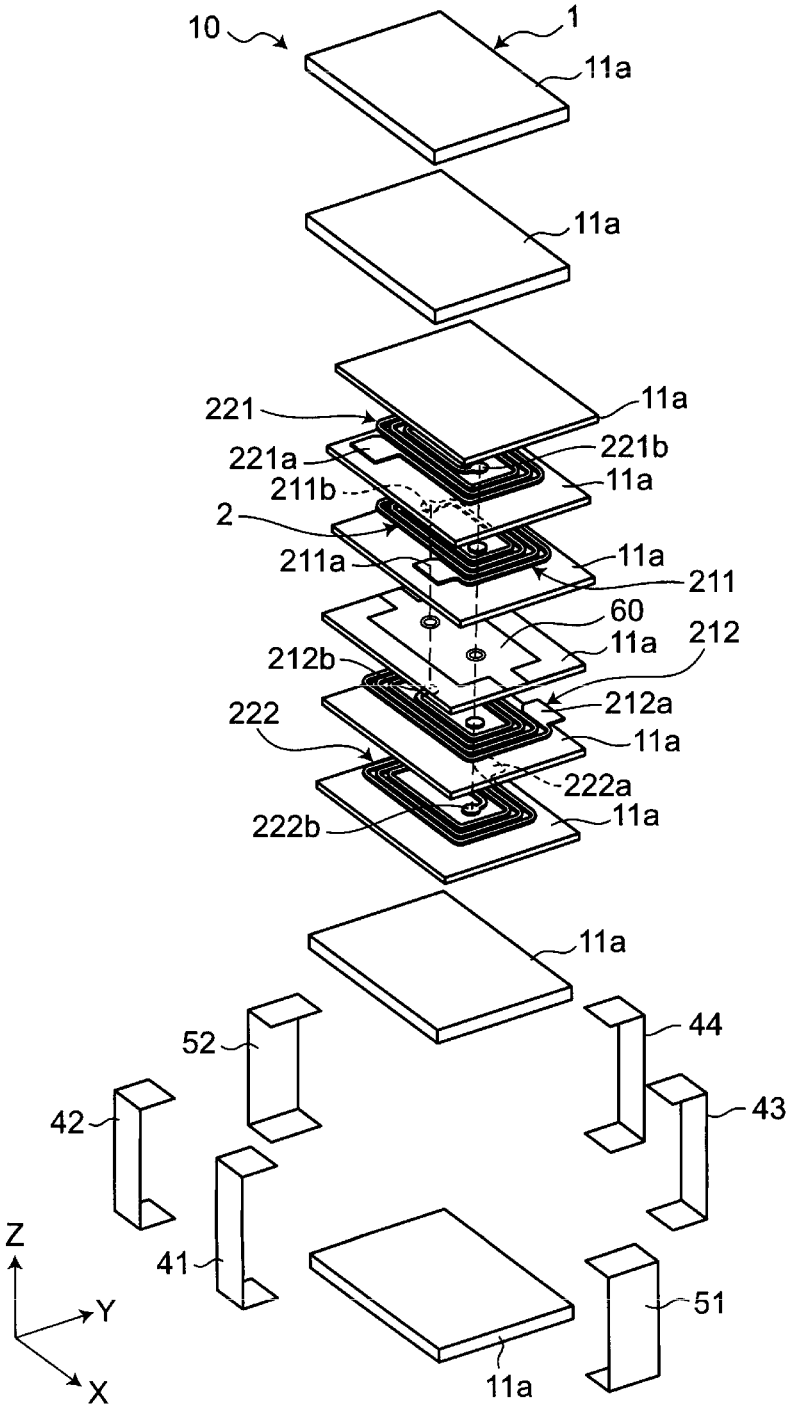
FIG. 3 is an exploded perspective view of the electronic component.

FIG. 1 is a perspective view illustrating an electronic component of a first embodiment of the present disclosure. FIG. 2 is a sectional view of the electronic component. FIG. 3 is an exploded perspective view of the electronic component. As illustrated in FIGS. 1 to 3, an electronic component 10 includes a multilayer body 1, a common mode choke coil 2 that is provided inside the multilayer body 1, an inner ground electrode 60 that is provided inside the multilayer body 1, and first and second ground terminals 51 and 52 that are connected to the inner ground electrode 60.

The electronic component 10 is electrically connected to a mounting substrate. The electronic component 10 is mounted in an electronic appliance such as a personal computer, a DVD player, a digital camera, a TV, a cellular phone or an in-car electronic appliance, for example.

The multilayer body 1 includes a plurality of insulating layers that are stacked on top of one another. More specifically, the multilayer body 1 includes a non-magnetic body 11. That is, the insulating layers include non-magnetic sheets 11*a*. The non-magnetic body 11 is formed of a resin material, a glass material or a glass ceramic material, for example.

The multilayer body 1 is formed in a substantially rectangular parallelepiped shape. A stacking direction of the multilayer body 1 is defined as a Z axis direction, a direction that extends along long edges of the multilayer body is defined as an X axis direction and a direction that extends along short edges of the multilayer body 1 is defined as a Y axis direction. The X axis, the Y axis and the Z axis are orthogonal to one another. An upward direction in the figures is taken to be an upward Z axis direction and a downward direction in the figures is taken to be a downward Z axis direction.

Surfaces of the multilayer body 1 include a first end surface 111, a second end surface 112, a first side surface 115, a second side surface 116, a third side surface 117 and a fourth side surface 118. The first end surface 111 and the second end surface 112 are positioned on opposite sides in the stacking direction (Z axis direction). The first to fourth side surfaces 115 to 118 are positioned between the first end surface 111 and the second end surface 112.

The first end surface 111 is a mounting surface that is mounted on the mounting substrate and is positioned on the lower side. The first side surface 115 and the third side surface 117 are short side surfaces and are positioned on opposite sides in the X axis direction. The second side surface 116 and the fourth side surface 118 are long side surfaces and are positioned on opposite sides in the Y axis direction.

The common mode choke coil 2 includes a plurality (two in this embodiment) of first coils 211 and 212 and a plurality (two in this embodiment) of second coils 221 and 222. The first coils 211 and 212 and the second coils 221 and 222 are arranged in the stacking direction inside the multilayer body 1 (non-magnetic body 11).

The first coils 211 and 212 and the second coils 221 and 222 are magnetically coupled with each other. The two first coils 211 and 212 are electrically connected to each other. The two second coils 221 and 222 are electrically connected to each other.

The two first coils 211 and 212 are interposed between one second coil 221 and the other second coil 222. That is, the coils are arranged in the order of the one second coil 221, one first coil 211, the other first coil 212 and the other second coil 222 from top to bottom. The first and second coils 211 to 222 are respectively provided on the non-magnetic sheets 11*a*. The first and second coils 211 to 222 are formed of a conductive material such as Ag, Ag—Pd, Cu or Ni, for example.

The first coils 211 and 212 and the second coils 221 and 222 include spiral patterns that are wound in substantially spiral shapes in the same direction when viewed from above. The two first coils 211 and 212 respectively have lead-out electrodes 211*a* and 212*a* at outer peripheral ends of the spiral shapes thereof and respectively have pad portions 211*b* and 212*b* at the other ends of the spiral shapes thereof in the center. The two second coils 221 and 222 respectively have lead-out electrodes 221*a* and 222*a* at outer peripheral ends of the spiral shapes thereof and respectively have pad portions 221*b* and 222*b* at the other ends of the spiral shapes thereof in the center.

The lead out electrode 211*a* of the one first coil 211 is exposed from the first side surface 115 side of the second side surface 116. The lead out electrode 221*a* of the one second coil 221 is exposed from the third side surface 117 side of the second side surface 116. The lead out electrode 212*a* of the other first coil 212 is exposed from the first side surface 115 side of the fourth side surface 118. The lead out electrode 222*a* of the other second coil 222 is exposed from the third side surface 117 side of the fourth side surface 118.

The pad portion 211*b* of the one first coil 211 and the pad portion 212*b* of the other first coil 212 are electrically connected to each other through via conductors of the non-magnetic sheets 11*a* interposed between the two first coils 211 and 212. That is, the one pad portion 211*b* is successively electrically connected to a via conductor that vertically penetrates through the non-magnetic sheet 11*a* on which the first coil 211 is formed, to a pad portion that is provided in an inner part of the inner ground electrode 60, to a via conductor that vertically penetrates through the non-magnetic sheet 11*a* on which the inner ground electrode 60 is formed and to the other pad portion 212*b*.

The pad portion 221*b* of the one second coil 221 and the pad portion 222*b* of the other second coil 222 are electrically connected to each other through via conductors of the non-magnetic sheets 11*a* interposed between the two second coils 221 and 222. That is, the one pad portion 221*b* is successively electrically connected to a via conductor that vertically penetrates through the non-magnetic sheet 11*a* on which the second coil 221 is formed, to a pad portion that is provided on the non-magnetic sheet 11*a* on which the first coil 211 is formed, to a via conductor that vertically penetrates through the non-magnetic sheet 11*a* on which the first coil 211 is formed, to a pad portion provided in an inner part of the inner ground electrode 60, to a via conductor that vertically penetrates through the non-magnetic sheet 11*a* on which the inner ground electrode 60 is formed, to a pad portion provided on the non-magnetic sheet 11*a* on which the first coil 212 is formed, to a via conductor that vertically penetrates through the non-magnetic sheet 11*a* on which the first coil 212 is formed, and to the pad portion 222*b*.

The first coils 211 and 212 and the second coils 221 and 222 are electrically connected to wiring lines on the mounting substrate via first to fourth coil terminals 41 to 44. The first to fourth coil terminals 41 to 44 are formed of a conductive material such as Ag, Ag—Pd, Cu or Ni, for example. The first to fourth coil terminals 41 to 44 are formed by applying the conductive material to the surfaces of the multilayer body 1 and then baking the conductive material, for example. The first to fourth coil terminals 41 to 44 are each formed in a substantially C-like shape.

The first coil terminal 41 is provided on a first side surface 115 side of the second side surface 116. One end portion of the first coil terminal 41 is folded over from the second side surface 116 so as to be provided on the first end surface 111. The other end portion of the first coil terminal 41 is folded over from the second side surface 116 so as to be provided on the second end surface 112. The first coil terminal 41 is electrically connected to the lead out electrode 211*a* of the one first coil 211.

The second coil terminal 42 is provided on a third side surface 117 side of the second side surface 116. The shape of the second coil terminal 42 is substantially the same as that of the first coil terminal 41 and therefore description thereof will be omitted. The second coil terminal 42 is electrically connected to the lead out electrode 221*a* of the one second coil 221.

The third coil terminal 43 is provided on a first side surface 115 side of the fourth side surface 118. The shape of the third coil terminal 43 is substantially the same as that of the first coil terminal 41 and therefore description thereof will be omitted. The third coil terminal 43 is electrically connected to the lead out electrode 212*a* of the other first coil 212.

The fourth coil terminal 44 is provided on a third side surface 117 side of the fourth side surface 118. The shape of the fourth coil terminal 44 is substantially the same as that of the first coil terminal 41 and therefore description thereof will be omitted. The fourth coil terminal 44 is electrically connected to the lead out electrode 222*a* of the other second coil 222.

The inner ground electrode 60 is arranged between the two first coils 211 and 212, which face each other in the stacking direction. Capacitances are generated between the inner ground electrode 60 and the first coils 211 and 212 and between the inner ground electrode 60 and the second coils 221 and 222.

The inner ground electrode 60 is provided on a non-magnetic sheet 11*a*. The inner ground electrode 60 is formed of a conductive material such as Ag, Ag—Pd, Cu or Ni, for example.

The inner ground electrode 60 is formed in a substantially rectangular shape and extends in the X axis direction. One end portion of the inner ground electrode 60 is exposed from the first side surface 115 and the other end portion of the inner ground electrode 60 is exposed from the third side surface 117. The inner ground electrode 60 is superposed with the first coils 211 and 212 and the second coils 221 and 222 when viewed in the stacking direction.

The first and second ground terminals 51 and 52 are formed of a conductive material such as Ag, Ag—Pd, Cu or Ni, for example. The first and second ground terminals 51 and 52 are formed by applying the conductive material to the surfaces of the multilayer body 1 and then baking the conductive material, for example. The first and second ground terminals 51 and 52 are each formed in a substantially C-like shape.

The first ground terminal 51 is provided on the first side surface 115. One end portion of the first ground terminal 51 is folded over from the first side surface 115 so as to be provided on the first end surface 111. The other end portion of the first ground terminal 51 is folded over from the first side surface 115 so as to be provided on the second end surface 112. The first ground terminal 51 electrically connects the one end portion of the inner ground electrode 60 and a ground wiring line on the mounting substrate to each other.

The second ground terminal 52 is provided on the third side surface 117. The shape of the second ground terminal 52 is substantially the same as that of the first ground terminal 51 and therefore description thereof will be omitted. The second ground terminal 52 electrically connects the other end portion of the inner ground electrode 60 and a ground wiring line on the mounting substrate to each other.

Next, a method of manufacturing the electronic component 10 will be described.

As illustrated in FIG. 3, the materials of the first coils 211 and 212 and the second coils 221 and 222 and the material of the inner ground electrode 60 are applied to different non-magnetic sheets 11*a* by performing printing, for example.

Then, the multilayer body 1 that includes the common mode choke coil 2 and the inner ground electrode 60 is obtained by stacking the non-magnetic sheets 11*a*, onto which the materials of the first coils 211 and 212 and the second coils 221 and 222 have been applied, and the non-magnetic sheet 11*a*, onto which the material of the inner ground electrode 60 has been applied, on top of one another and performing firing.

Next, the first to fourth coil terminals 41 to 44 and the first and second ground terminals 51 and 52 are formed on the surfaces of the multilayer body 1 by applying the materials of the first to fourth coil terminals 41 to 44 to the surfaces of the multilayer body 1 by performing printing or the like, applying the materials of the first and second ground terminals 51 and 52 to the surfaces of the multilayer body 1 by performing printing or the like and then baking these materials. Thus, the electronic component 10 is manufactured.

In the electronic component 10, the inner ground electrode 60 is arranged between the two first coils 211 and 212, which face each other in the stacking direction. Thus, capacitances are generated between the inner ground electrode and the first coils 211 and 212 and between the inner ground electrode 60 and the second coils 221 and 222 and a so-called T-type LC filter structure is formed as an equivalent circuit. Therefore, resonance can be obtained with smaller capacitance values than in the π-type LC filter structure of the related art and a reduction in signal quality can be suppressed by reducing degradation of the signal transmission characteristic Sdd21.

Furthermore, since the inner ground electrode 60 is arranged between the two first coils 211 and 212, which face each other in the stacking direction, coupling between the first coils 211 and 212 and the second coils 221 and 222 is strengthened compared with the case where the inner ground electrode 60 is arranged between first coils and second coils, and degradation of the signal transmission characteristic Sdd21 is reduced and reduction of signal quality can be suppressed. That is, since the inner ground electrode 60 is interposed between the first coils 211 and 212, which constitute the same coil, canceling out of magnetic flux of the first and second coils 211 to 222 does not occur and magnetic flux does not remain at the inner ground electrode 60 in the case where a differential mode current flows in the first coils 211 and 212 and the second coils 221 and 222. Thus, the coupling between the first coils 211 and 212 and the second coils 221 and 222 is strengthened and the signal transmission characteristic Sdd21 is improved.

Figure 4:
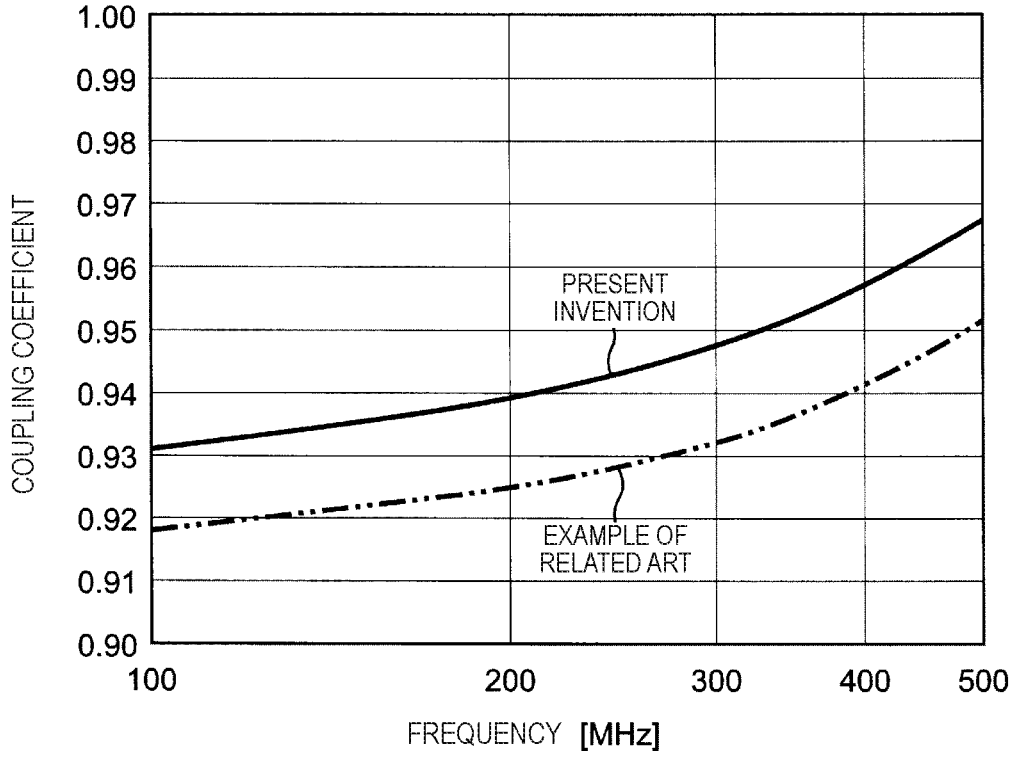
FIG. 4 illustrates graphs for explaining a comparison of coupling coefficients in the present disclosure and an example of the related art.

FIG. 4 illustrates a comparison of the present disclosure (a structure in which the inner ground electrode is arranged between two first coils) and an example of the related art (a structure in which the inner ground electrode is arranged between a first coil and a second coil). In FIG. 4, the horizontal axis represents frequency and the vertical axis represents the coupling coefficient. As illustrated in FIG. 4, the coupling coefficient is improved in the present disclosure (solid line) compared to the example of the related art (two dot chain line).

According to the electronic component 10, two first coils 211 and 212 are interposed between the one second coil 221 and the other second coil 222 and therefore coupling between the first coils 211 and 212 and second coils 221 and 222 is strengthened.

Second Embodiment

Figure 5:
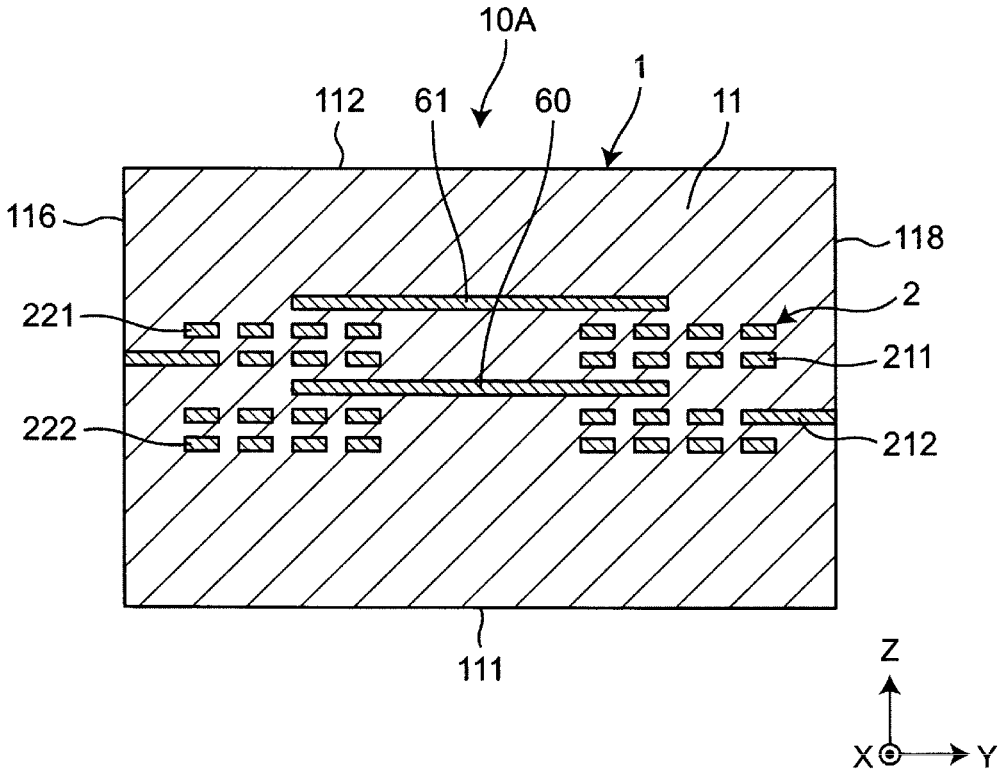
FIG. 5 is a YZ sectional view illustrating a second embodiment of an electronic component of the present disclosure.

FIG. 5 is a YZ sectional view illustrating a second embodiment of an electronic component of the present disclosure. The second embodiment differs from the first embodiment in that an outer ground electrode is provided. This difference will be described below. In the second embodiment, the same symbols as in the first embodiment are used to denote constituent parts that are the same as in the first embodiment and therefore description of those constituent parts will be omitted.

As illustrated in FIG. 5, in an electronic component 10A of the second embodiment, the one second coil 221 is arranged at the uppermost position in the stacking direction among the first and second coils 211 to 222, and an outer ground electrode 61 that faces the second coil 221 is provided closer to the outside (upper side) in the stacking direction than the second coil 221. The outer ground electrode 61 is arranged inside the multilayer body 1 (non-magnetic body 11).

The outer ground electrode 61 is formed of a conductive material such as Ag, Ag—Pd, Cu or Ni, for example. The outer ground electrode 61 is formed in a substantially rectangular shape and extends in the X axis direction.

One end portion of the outer ground electrode 61 is exposed from the first side surface 115 and is electrically connected to the first ground terminal 51. The other end portion of the outer ground electrode 61 is exposed from the third side surface 117 and is electrically connected to the second ground terminal 52. The outer ground electrode 61 is superposed with the first coils 211 and 212 and the second coils 221 and 222 when viewed in the stacking direction.

Figure 6:
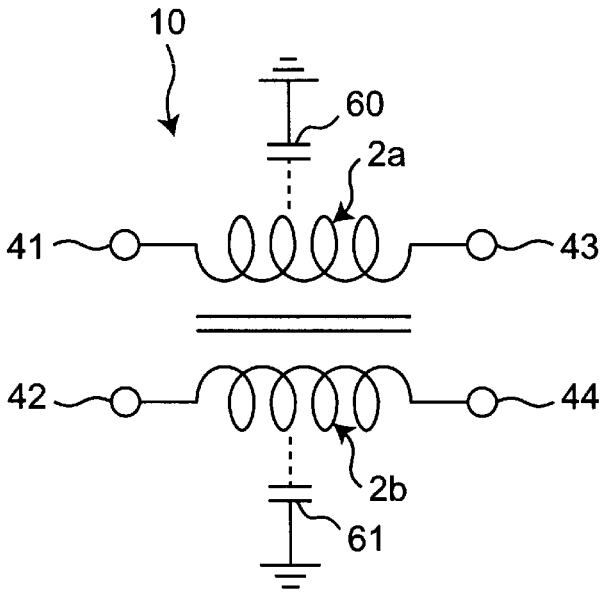
FIG. 6 is an equivalent circuit diagram of the electronic component.

FIG. 6 is an equivalent circuit diagram of the electronic component 10A. As illustrated in FIG. 6, a first coil group 2*a*, which is made up of the two first coils 211 and 212, is connected between the first coil terminal 41 and the third coil terminal 43. A second coil group 2*b*, which is made up of the two second coils 221 and 222, is connected between the second coil terminal 42 and the fourth coil terminal 44. The inner ground electrode 60 is arranged so as to face the first coil group 2*a* and the outer ground electrode 61 is arranged so as to face the second coil group 2*b*. In other words, a so-called T-type LC filter structure is formed as an equivalent circuit.

In the electronic component 10A, the outer ground electrode 61 is arranged closer to the outside in the stacking direction than the one second coil 221 and therefore it is possible to match the value of the capacitance between the first coils 211 and 212 and the ground and the value of the capacitance between the second coils 221 and 222 and the ground with each other and the electrical characteristics are improved.

The outer ground electrode may also be provided so as to be closer to the outside in the stacking direction than the second coil at the lowermost position in the stacking direction among the first and second coils.

Third Embodiment

Figure 7:
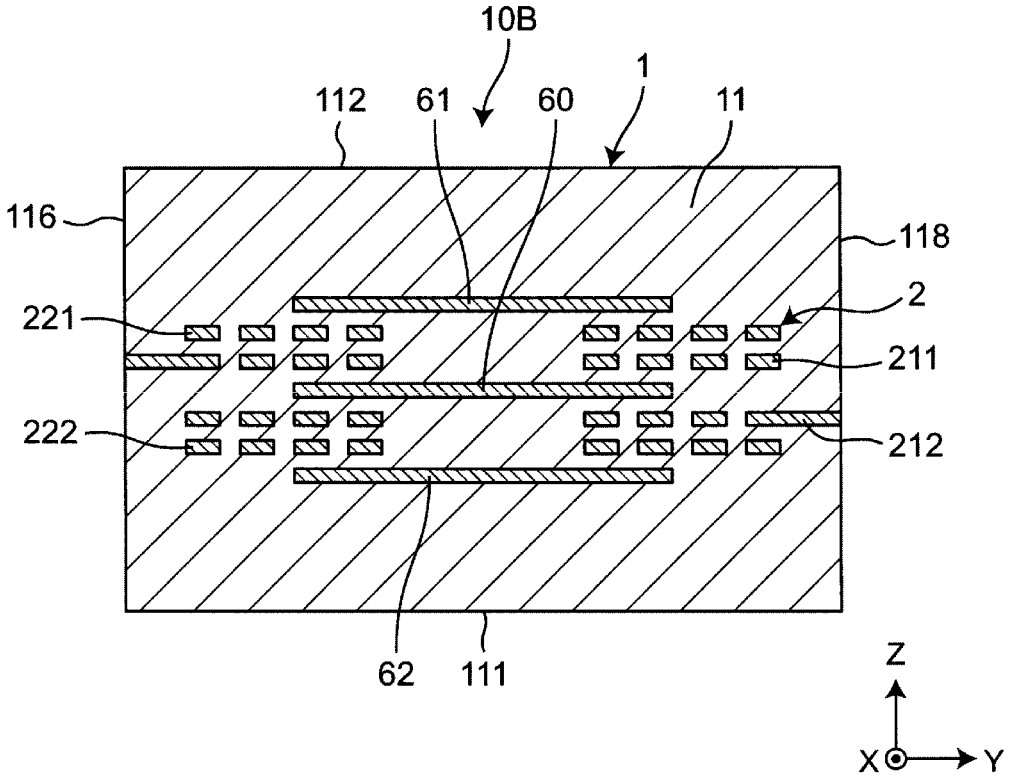
FIG. 7 is a YZ sectional view illustrating a third embodiment of an electronic component of the present disclosure.

FIG. 7 is a YZ sectional view illustrating a third embodiment of an electronic component of the present disclosure. The third embodiment differs from the first embodiment in that outer ground electrodes are provided. This difference will be described below. In the third embodiment, the same symbols as in the first embodiment are used to denote constituent parts that are the same as in the first embodiment and therefore description of those constituent parts will be omitted.

As illustrated in FIG. 7, in an electronic component 10B of the third embodiment, the second coils 221 and 222 are arranged at an uppermost position and a lowermost position in the stacking direction among the first and second coils 211 to 222. A first outer ground electrode 61 that faces the second coil 221 is provided closer to the outside (upper side) in the stacking direction than the one second coil 221. A second outer ground electrode 62 that faces the second coil 222 is provided closer to the outside (lower side) in the stacking direction than the other second coil 222. The first and second outer ground electrodes 61 and 62 are arranged inside the multilayer body 1 (non-magnetic body 11).

The first and second outer ground electrodes 61 and 62 are formed of a conductive material such as Ag, Ag—Pd, Cu or Ni, for example. The first and second outer ground electrodes 61 and 62 are formed in substantially rectangular shapes and extend in the X axis direction.

One end portion of each of the first and second outer ground electrodes 61 and 62 is exposed from the first side surface 115 and is electrically connected to the first ground terminal 51. The other end portion of each of the first and second outer ground electrodes 61 and 62 is exposed from the third side surface 117 and is electrically connected to the second ground terminal 52. The first and second outer ground electrodes 61 and 62 are superposed with the first coils 211 and 212 and the second coils 221 and 222 when viewed in the stacking direction.

In the electronic component 10B, the first and second outer ground electrodes 61 and 62 are arranged closer to the outside in the stacking direction than the two second coils 221 and 222 and therefore it is possible to match the value of the capacitance between the first coils 211 and 212 and the ground and the value of the capacitance between the second coils 221 and 222 and the ground with each other and the electrical characteristics are improved. In addition, since a vertically symmetrical chip structure is formed, balancing of contraction and stress that are generated when firing is performed can be achieved.

Fourth Embodiment

Figure 8:
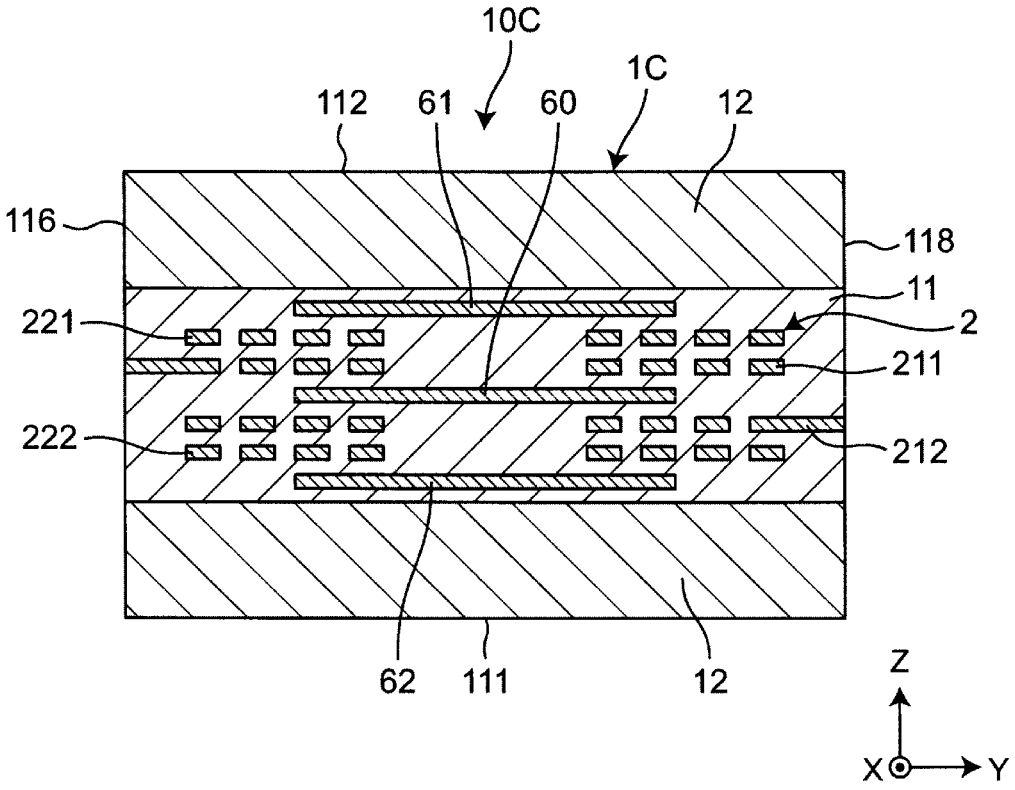
FIG. 8 is a YZ sectional view illustrating a fourth embodiment of an electronic component of the present disclosure.

FIG. 8 is a YZ sectional view illustrating a fourth embodiment of an electronic component of the present disclosure. The fourth embodiment differs from the third embodiment in terms of the configuration of the multilayer body. This difference will be described below. In the fourth embodiment, the same symbols as in the third embodiment are used to denote constituent parts that are the same as in the third embodiment and therefore description of those constituent parts will be omitted.

As illustrated in FIG. 8, in an electronic component 10C of the fourth embodiment, a multilayer body 1C includes the non-magnetic body 11 and magnetic bodies 12 that vertically sandwich the non-magnetic body 11 therebetween in the stacking direction. That is, the insulating layers include the non-magnetic sheets 11*a* and magnetic sheets 12*a*. The magnetic bodies 12 are composed of a magnetic material such as ferrite.

The first and second coils 211 to 222 are arranged inside the non-magnetic body 11. The inner ground electrode 60 and the first and second outer ground electrodes 61 and 62 are arranged inside the non-magnetic body 11.

In the electronic component 10C, the first and second coils 211 to 222 and the first and second outer ground electrodes 61 and 62 are arranged inside the non-magnetic body and the non-magnetic body 11 is vertically sandwiched between the magnetic bodies 12 and therefore the magnetic flux of the first and second coils 211 to 222 is concentrated in the magnetic bodies 12 above and below the non-magnetic body 11. Therefore, magnetic flux that flows around individual coils among first and second coils 211 to 222 is reduced and shared magnetic flux that flows around the first and second coils 211 to 222 is increased. Therefore, coupling between the first coils 211 and 212 and the second coils 221 and 222 can be strengthened and consequently degradation of the signal transmission characteristic Sdd21 can be further reduced. That is, the common mode impedance is increased and the differential mode impedance is reduced.

At least one of the first and second outer ground electrodes may be omitted.

Fifth Embodiment

Figure 9:
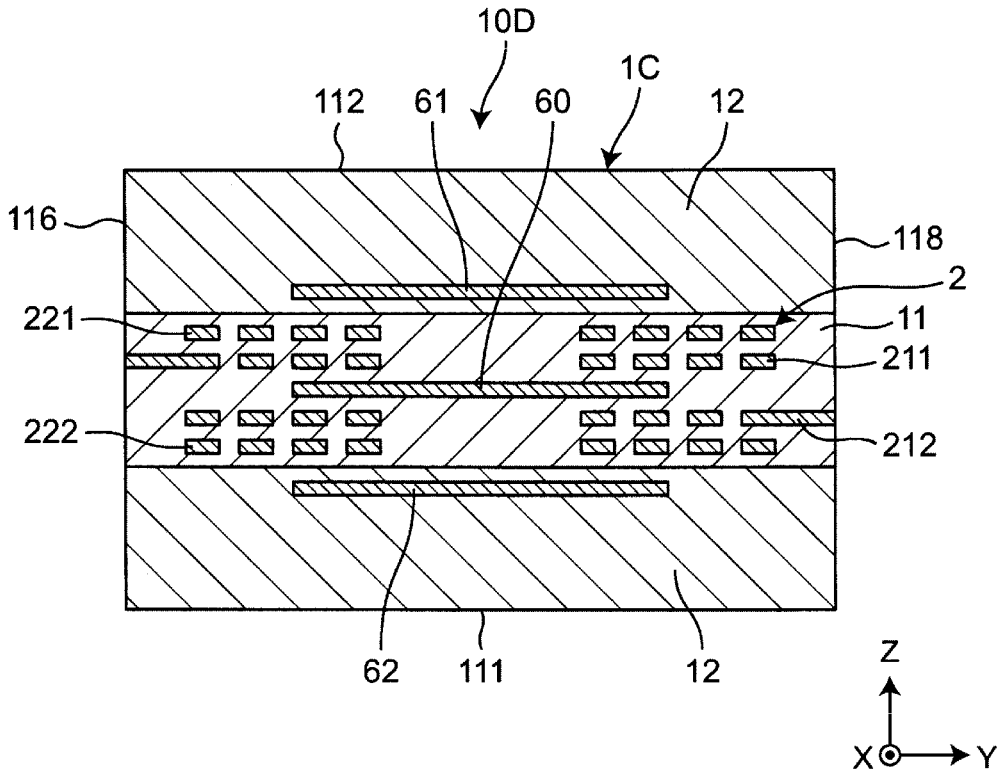
FIG. 9 is a YZ sectional view illustrating a fifth embodiment of an electronic component of the present disclosure.

FIG. 9 is a YZ sectional view illustrating a fifth embodiment of an electronic component of the present disclosure. The fifth embodiment differs from the fourth embodiment in terms of the positions of the outer ground electrodes. This difference will be described below. In the fifth embodiment, the same symbols as in the fourth embodiment are used to denote constituent parts that are the same as in the fourth embodiment and therefore description of those constituent parts will be omitted.

As illustrated in FIG. 9, in an electronic component 10D of the fifth embodiment, the first outer ground electrode is arranged inside the upper magnetic body 12 and the second outer ground electrode 62 is arranged in the lower magnetic body 12.

In the electronic component 10D, the first and second outer ground electrodes 61 and 62 can be arranged in the magnetic bodies 12, which are different bodies to the non-magnetic body 11 in which the first and second coils 211 to 222 are arranged, and consequently an increase in stress in the non-magnetic body 11 caused by the electrodes being concentrated in the non-magnetic body 11 is relaxed and the occurrence of structural defects and a decrease in reliability can be suppressed. Furthermore, the distance between the upper and lower magnetic bodies 12 can be reduced by decreasing the thickness of the non-magnetic body 11, and magnetic flux in the case where common mode noise flows is further strengthened. Therefore, the inductance and impedance for common mode noise become larger and the attenuation in a common mode noise attenuation characteristic Scc21 can be increased.

Sixth Embodiment

Figure 10:
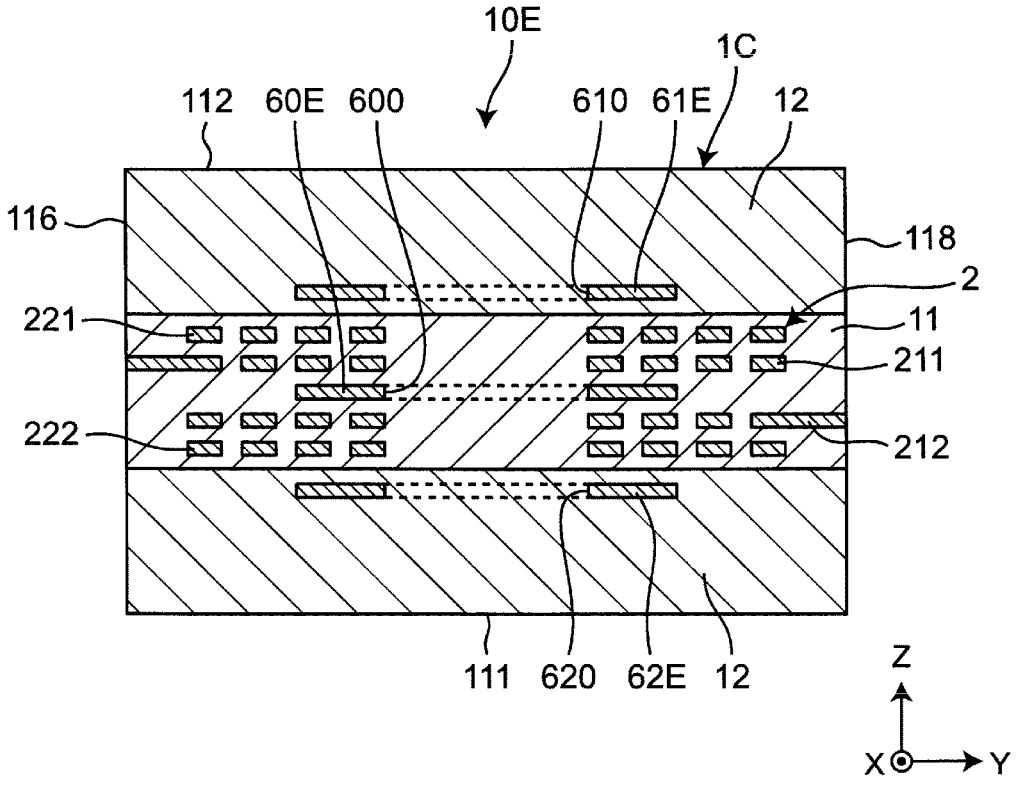
FIG. 10 is a YZ sectional view illustrating a sixth embodiment of an electronic component of the present disclosure.
Figure 11:
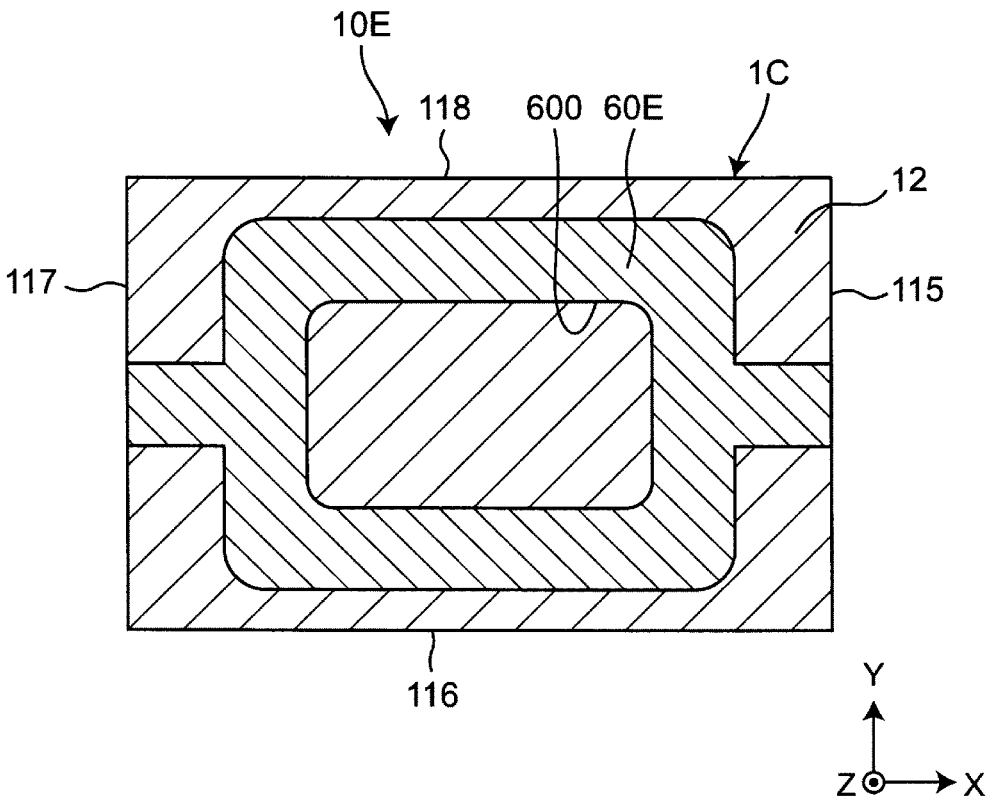
FIG. 11 is an XY sectional view of the electronic component.

FIG. 10 is a YZ sectional view illustrating a sixth embodiment of an electronic component of the present disclosure. FIG. 11 is an XY sectional view illustrating the sixth embodiment of an electronic component of the present disclosure. The sixth embodiment differs from the fifth embodiment in terms of the configurations of the inner ground electrode and the outer ground electrodes. Only these different configurations will be described below. In the sixth embodiment, the same symbols as in the fifth embodiment are used to denote constituent parts that are the same as in the fifth embodiment and therefore description of those constituent parts will be omitted.

As illustrated in FIGS. 10 and 11, in an electronic component 10E of the sixth embodiment, an inner ground electrode 60E is superposed with the first coils 211 and 212, which face the inner ground electrode 60E, and is not superposed with inner diameter parts of the first coils 211 and 212, when viewed in the stacking direction.

Similarly, a first outer ground electrode 61E is superposed with the one second coil 221, which faces the first outer ground electrode 61E, and is not superposed with an inner diameter part of the one second coil 221 when viewed in the stacking direction. A second outer ground electrode 62E is superposed with the other second coil 222, which faces the second outer ground electrode 62E, and is not superposed with an inner diameter part of the other second coil 222 when viewed in the stacking direction.

More specifically, the inner ground electrode 60E has an inner diameter part 600 that is substantially the same size as inner diameter parts of the first coils 211 and 212 when viewed in the stacking direction. The inner diameter part 600 of the inner ground electrode 60E is superposed with the inner diameter parts of the first coils 211 and 212 when viewed in plan. The inner diameter parts of the first and second coils 211 to 222 all have substantially the same size when viewed in the stacking direction.

Similarly, the first outer ground electrode 61E has an inner diameter part 610 that is substantially the same size as an inner diameter part of the one second coil 221 when viewed in the stacking direction. The second outer ground electrode 62E has an inner diameter part 620 that is substantially the same size as an inner diameter part of the other second coil 222 when viewed in the stacking direction.

In the electronic component 10E, the inner ground electrode 60E is not superposed with the inner diameter parts of the first coils 211 and 212 when viewed in the stacking direction and the first and second outer ground electrodes 61E and 62E are not superposed with the inner diameter parts of the second coils 221 and 222 when viewed in the stacking direction. As a result, magnetic flux of the first and second coils 211 to 222 is not blocked by the inner and outer ground electrodes 60E, 61E and 62E and degradation of characteristics due to the effect of loss of magnetic flux can be suppressed.

Seventh Embodiment

Figure 12:
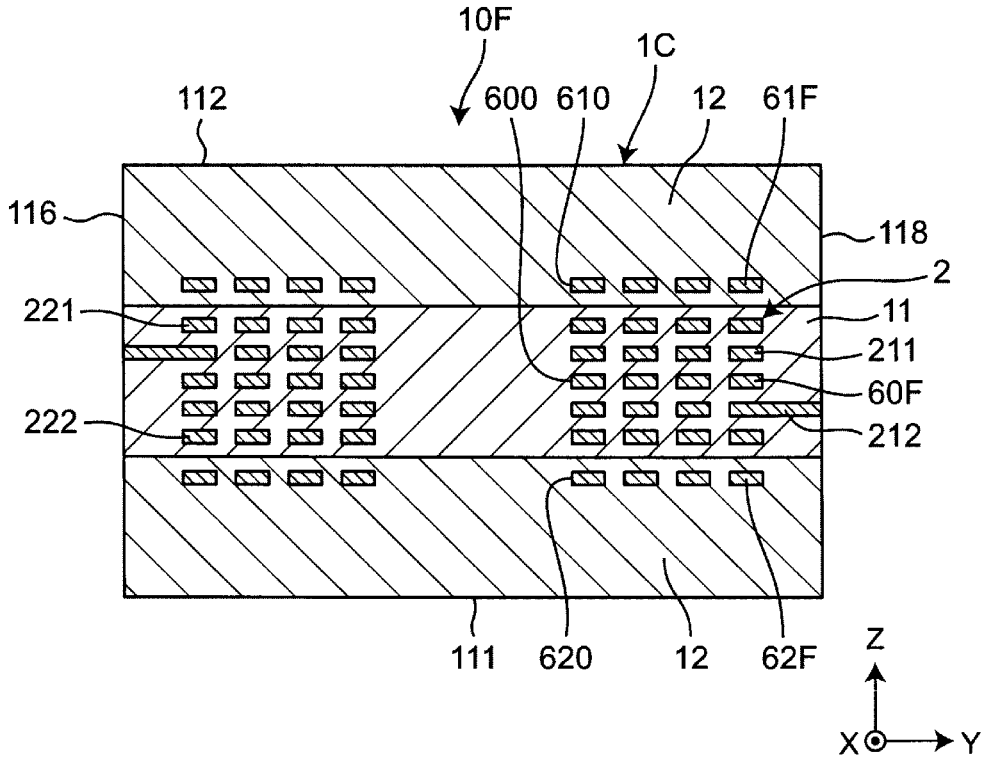
FIG. 12 is a YZ sectional view illustrating a seventh embodiment of an electronic component of the present disclosure.
Figure 13A:
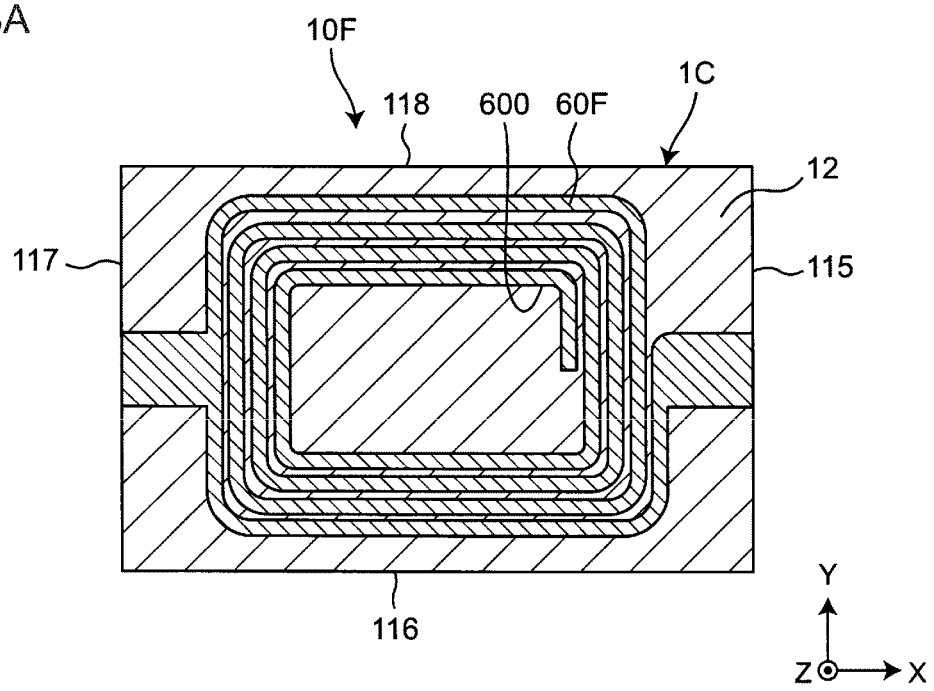
FIG. 13A is an XY sectional view of an electronic component.
Figure 13B:
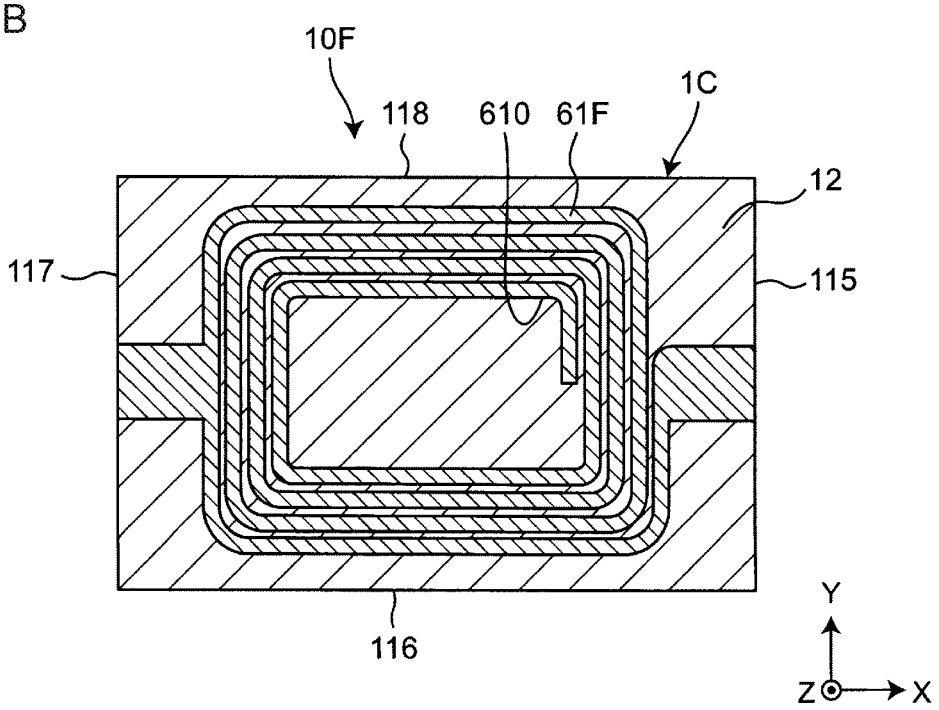
FIG. 13B is an XY sectional view of the electronic component.

FIG. 12 is a YZ sectional view illustrating a seventh embodiment of an electronic component of the present disclosure. FIGS. 13A and 13B are XY sectional views illustrating the seventh embodiment of an electronic component of the present disclosure. The seventh embodiment differs from the sixth embodiment in terms of the configurations of the inner ground electrode and the outer ground electrodes. Only these different configurations will be described below. In the seventh embodiment, the same symbols as in the sixth embodiment are used to denote constituent parts that are the same as in the sixth embodiment and therefore description of those constituent parts will be omitted.

As illustrated in FIGS. 12, 13A and 13B, in an electronic component 10F of the seventh embodiment, an inner ground electrode 60F has a pattern that is similar to the patterns of the first coils 211 and 212 that face the inner ground electrode 60F when viewed in the stacking direction. More specifically, the pattern of the inner ground electrode 60F has a substantially spiral shape that has substantially the same inner diameter, line width and line separation as the patterns of the first coils 211 and 212 and the pattern of the inner ground electrode 60F is arranged at such a position as to be superposed with the patterns of the first coils 211 and 212.

Similarly, a first outer ground electrode 61F has a pattern that is similar to the pattern of the one second coil 221 that faces the first outer ground electrode 61F when viewed in the stacking direction. More specifically, the first outer ground electrode 61F has a substantially spiral shape that has substantially the same inner diameter, line width and line separation as the pattern of the second coil 221 and the first outer ground electrode 61F is arranged at such a position as to be superposed with the pattern of the second coil 221.

Similarly, a second outer ground electrode 62F has a pattern that is similar to the pattern of the other second coil 222 that faces the second outer ground electrode 62F when viewed in the stacking direction. That is, the second outer ground electrode 62F has a substantially spiral shape that has substantially the same inner diameter, line width and line separation as the pattern of the second coil 222 and the second outer ground electrode 62F is arranged at such a position as to be superposed with the pattern of the second coil 222.

In the electronic component 10F, the inner ground electrode 60F has a similar pattern to the first coils 211 and 212 when viewed in the stacking direction, and the first and second outer ground electrodes 61F and 62F have similar patterns to the second coils 221 and 222 when viewed in the stacking direction. Consequently, the surface areas of the inner and outer ground electrodes 60F, 61F and 62F when looking in the stacking direction can be reduced to the minimum and the capacitances can be efficiently obtained. In addition, since the surface areas of the inner and outer ground electrodes 60F, 61F and 62F can be reduced, the occurrence of stress caused by differences in the coefficient of linear expansion between the inner and outer ground electrodes 60F, 61F and 62F and the multilayer body 1C can be reduced.

Eighth Embodiment

Figure 14:
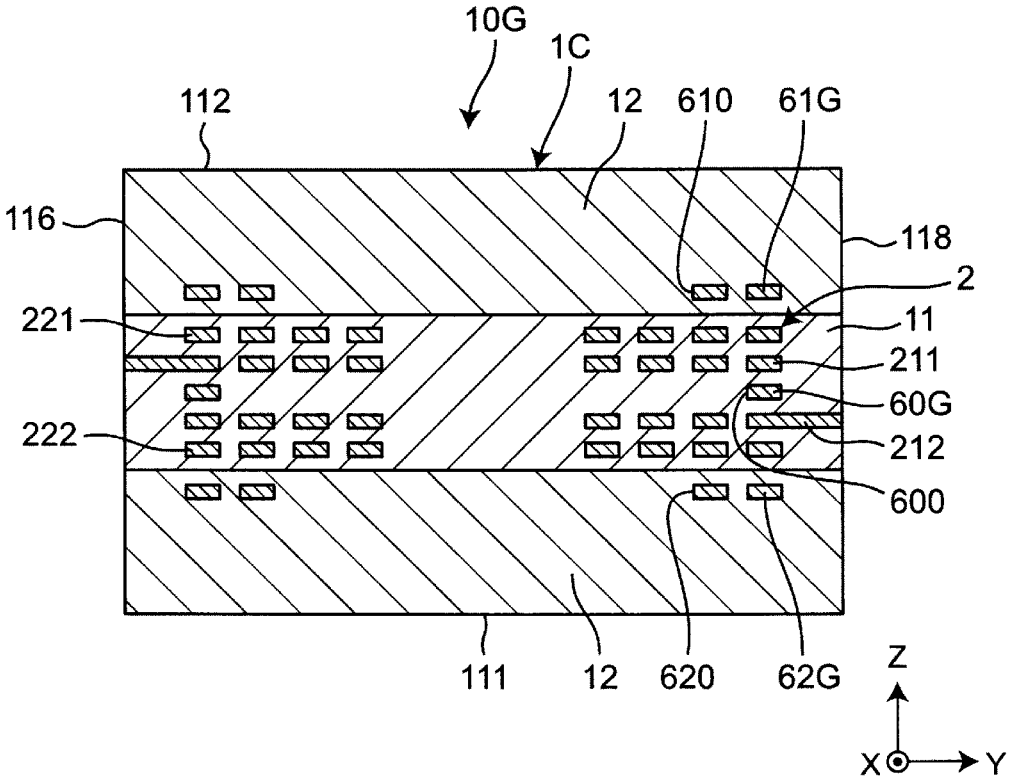
FIG. 14 is a YZ sectional view illustrating an eighth embodiment of an electronic component of the present disclosure.
Figure 15A:
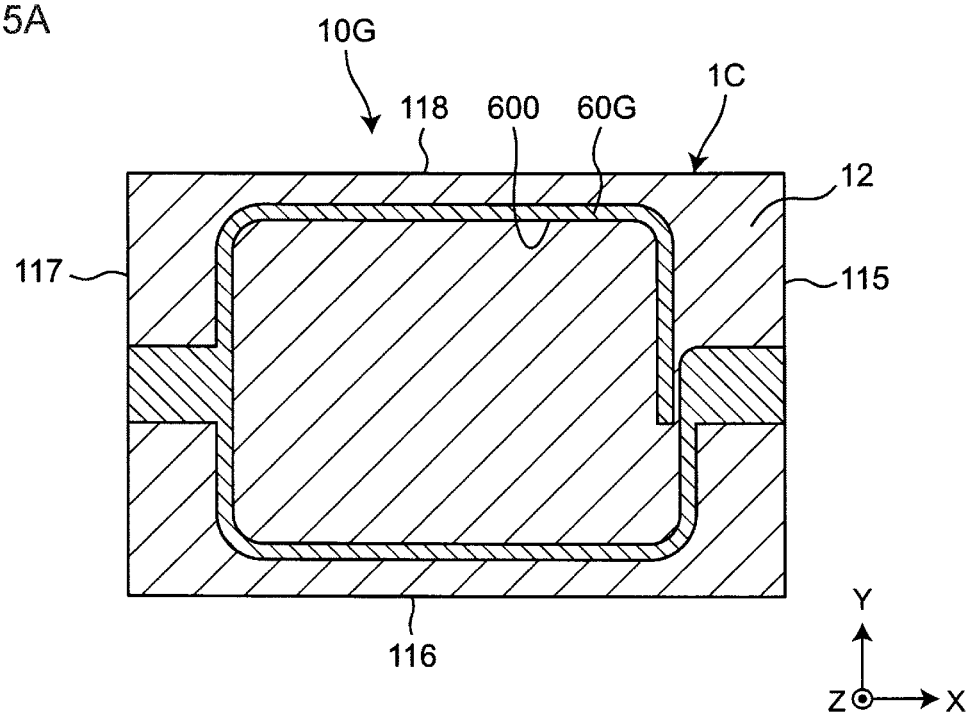
FIG. 15A is a XY sectional view of the electronic component.
Figure 15B:
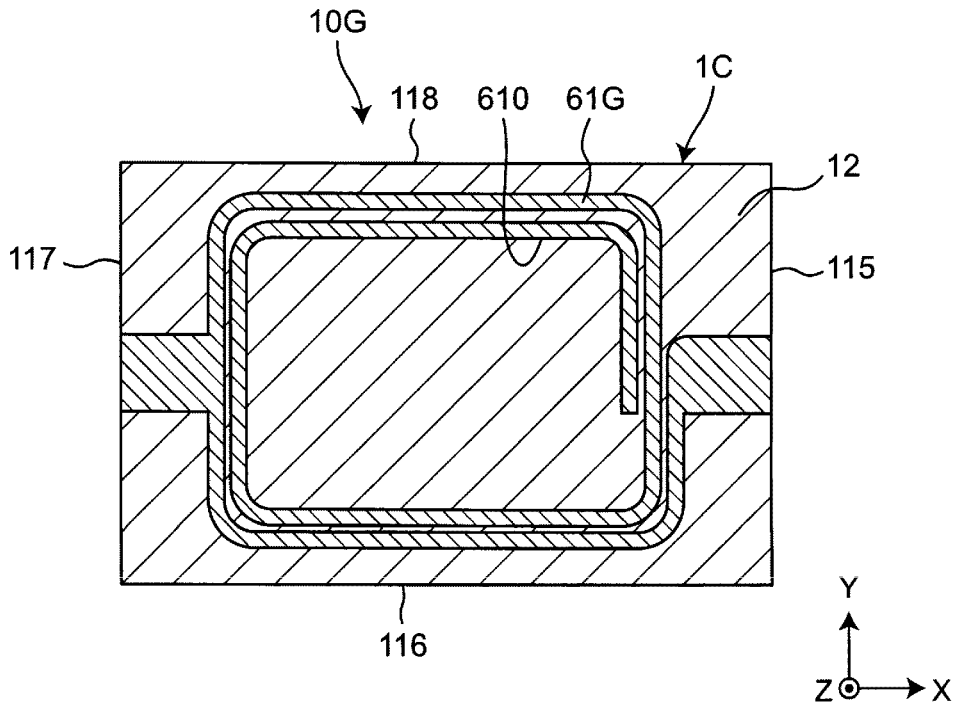
FIG. 15B is a XY sectional view of the electronic component.

FIG. 14 is a YZ sectional view illustrating an eighth embodiment of an electronic component of the present disclosure. FIGS. 15A and 15B are XY sectional views illustrating the eighth embodiment of an electronic component of the present disclosure. The eighth embodiment differs from the seventh embodiment in terms of the configurations of the inner ground electrode and the outer ground electrodes. Only these different configurations will be described below. In the eighth embodiment, the same symbols as in the seventh embodiment are used to denote constituent parts that are the same as in the seventh embodiment and therefore description of those constituent parts will be omitted.

As illustrated in FIGS. 14, 15A and 15B, in an electronic component 10G of the eighth embodiment, the surfaces areas of first and second outer ground electrodes 61G and 62G when looking in the stacking direction are each larger than the surface area of an inner ground electrode 60G when looking in the stacking direction. More specifically, the inner and outer ground electrodes 60G, 61G and 62G are formed in substantially spiral shapes and the lengths of the spiral shapes of the first and second outer ground electrodes 61G and 62G are longer than the length of the spiral shape of the inner ground electrode 60G. In this embodiment, the number of turns of the inner ground electrode 60G is one turn and the number of turns of the first and second outer ground electrodes 61G and 62G is two turns.

In the electronic component 10G, the surface areas of the first and second outer ground electrodes 61G and 62G when looking in the stacking direction are larger than the surface area of the inner ground electrode 60G when looking in the stacking direction and therefore even when the distance between the first outer ground electrode 61G inside the magnetic body 12 and the second coil 221 inside the non-magnetic body 11 and the distance between the second outer ground electrode 62G inside the magnetic body 12 and the second coil 222 inside the non-magnetic body 11 are larger than the distance between the inner ground electrode 60G inside the non-magnetic body 11 and the first coils 211 and 212 inside the non-magnetic body 11, the value of the capacitance between the first coils 211 and 212 and the ground and the value of the capacitance between the second coils 221 and 222 and the ground are substantially the same and the electrical characteristics are improved.

Furthermore, since the lengths of the spiral shapes of the first and second outer ground electrodes 61G and 62G are longer than the length of the spiral shape of the inner ground electrode 60G, the surface areas of the first and second outer ground electrodes 61G and 62G when looking in the stacking direction can be made larger than the surface area of the inner ground electrode 60G when looking in the stacking direction by using a simple configuration.

The lengths of the spiral shapes of the first and second outer ground electrodes and the length of the spiral shape of the inner ground electrode may be the same, and the surface areas of the first and second outer ground electrodes when looking in the stacking direction may be made larger than the surface area of the inner ground electrode when looking in the stacking direction by making the line widths of the first and second outer ground electrodes be larger than the line width of the inner ground electrode.

The surface areas of the first and second outer ground electrodes when looking in the stacking direction are preferably 2.2 to 3.8 times and more preferable 3.0 times the surface area of the inner ground electrode when looking in the stacking direction. As a result, the electrical characteristics are further improved.

The Table illustrates the relationship between: the ratio of the surface area of the first/second outer ground electrode in the stacking direction to the surface area of the inner ground electrode in the stacking direction; and peak attenuation of the common mode noise Scc21.

TABLE

| | | | | | | | |
|---|---|---|---|---|---|---|---|
| Surface area of first, second outer ground electrode/ surface area of inner ground electrode | 1.0 | 1.9 | 2.2 | 2.5 | 3.0 | 3.8 | 4.7 |
| Peak attenuation (dB) of common mode noise Scc21 | 32.0 | 36.4 | 40.0 | 43.0 | 52.2 | 40.0 | 32.0 |

As illustrated in the Table, a peak attenuation of 40 dB or higher can be obtained in the common mode noise Scc21 for values in the range of 2.2 times to 3.8 times. In addition, the largest attenuation can be obtained when the value is 3.0 times.

Ninth Embodiment

Figure 16:
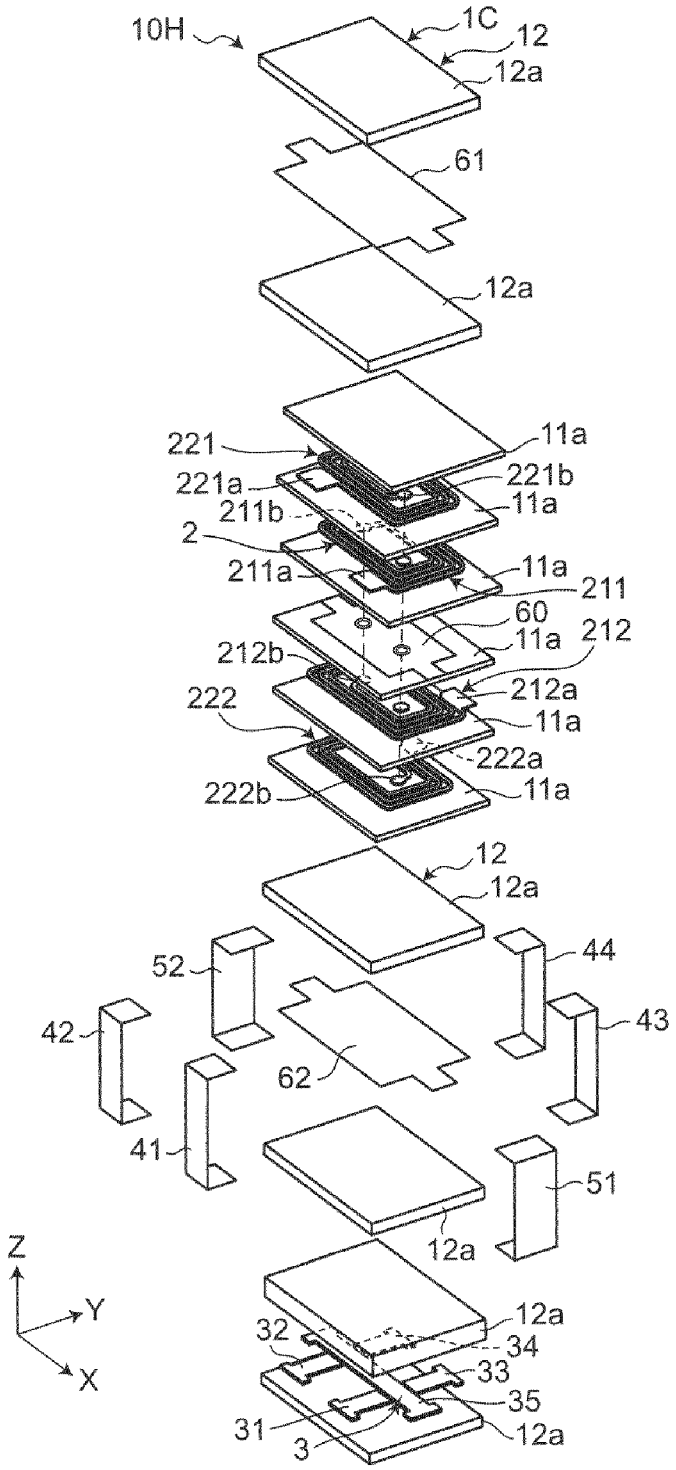
FIG. 16 is a perspective view illustrating an electronic component of a ninth embodiment of the present disclosure.
Figure 17:
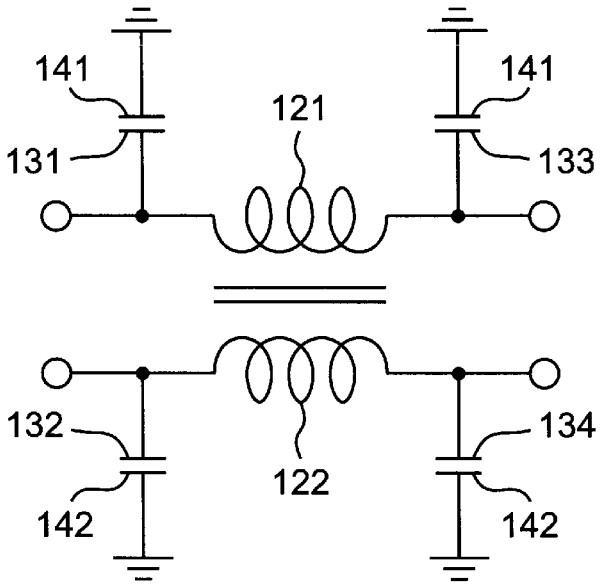
FIG. 17 is an equivalent circuit diagram of an electronic component of the related art.

FIG. 16 is a perspective view illustrating a ninth embodiment of an electronic component of the present disclosure. The ninth embodiment differs from the fifth embodiment in that the ninth embodiment includes an electrostatic discharge element. Only this difference will be described below. In the ninth embodiment, the same symbols as in the fifth embodiment are used to denote constituent parts that are the same as in the fifth embodiment and therefore description of those constituent parts will be omitted.

As illustrated in FIG. 16, an electronic component 10H of the ninth embodiment includes an electrostatic discharge (ESD) element 3. The electrostatic discharge element 3 is provided in the multilayer body 1C and is positioned closer to the lower side than the second outer ground electrode 62. The electrostatic discharge element 3 is connected to the first coils 211 and 212 and the second coils 221 and 222 via the first to fourth coil terminals 41 to 44 and is connected to ground via the first and second ground terminals 51 and 52.

The electrostatic discharge element 3 includes first to fifth discharge electrodes 31 to 35. The first to fifth discharge electrodes 31 to 35 are sandwiched between upper and lower magnetic sheets 12*a*. The first to fourth discharge electrodes 31 to 34 extend in the Y axis direction. The fifth discharge electrode 35 extends in the X axis direction.

One end portion of the first discharge electrode 31 is exposed from the first side surface 115 side of the second side surface 116 and the other end portion of the first discharge electrode 31 is positioned in the center of the magnetic body 12 in the Y direction. One end portion of the second discharge electrode 32 is exposed from the third side surface 117 side of the second side surface 116 and the other end portion of the second discharge electrode 32 is positioned in the center of the magnetic body 12 in the Y direction.

One end portion of the third discharge electrode 33 is exposed from the first side surface 115 side of the fourth side surface 118 and the other end portion of the third discharge electrode 33 is positioned in the center of the magnetic body 12 in the Y direction. One end portion of the fourth discharge electrode 34 is exposed from the third side surface 117 side of the fourth side surface 118 and the other end portion of the fourth discharge electrode 34 is positioned in the center of the magnetic body 12 in the Y direction.

One end portion of the fifth discharge electrode 35 is positioned in a gap between the other end portion of the first discharge electrode 31 and the other end portion of the third discharge electrode 33. A discharge gap is provided between the one end portion of the fifth discharge electrode 35 and the other end portion of the first discharge electrode 31. A discharge gap is provided between the one end portion of the fifth discharge electrode 35 and the other end portion of the third discharge electrode 33.

The other end portion of the fifth discharge electrode 35 is positioned in a gap between the other end portion of the second discharge electrode 32 and the other end portion of the fourth discharge electrode 34. A discharge gap is provided between the other end portion of the fifth discharge electrode 35 and the other end portion of the second discharge electrode 32. A gap discharge is provided between the other end portion of the fifth discharge electrode 35 and the other end portion of the fourth discharge electrode 34.

The one end portion of the fifth discharge electrode 35 is exposed from the first side surface 115. The other end portion of the fifth discharge electrode 35 is exposed from the third side surface 117.

There may be no material in the discharge gaps or the discharge gaps may be filled with a material that readily discharges. Examples of a material that readily discharges include coated particles and semiconductor particles. Coated particles are particles obtained by coating the surfaces of metal particles such as Cu particles with an inorganic material such as alumina. Semiconductor particles are particles of a semiconductor material such as SiC. It is preferable that the coated particles and the semiconductor particles be arranged in a dispersed manner. By dispersing the coated particles and the semiconductor particles, it is easy to prevent shorts and adjust ESD characteristics such as the discharge start voltage.

The one end portion of the first discharge electrode 31 is electrically connected to the lead out electrode 211*a* of the first coil 211 via the first coil terminal 41. The one end portion of the second discharge electrode 32 is electrically connected to the lead out electrode 221*a* of the second coil 221 via the second coil terminal 42.

The one end portion of the third discharge electrode 33 is electrically connected to the lead out electrode 212*a* of the first coil 212 via the third coil terminal 43. The one end portion of the fourth discharge electrode 34 is electrically connected to the lead out electrode 222*a* of the second coil 222 via the fourth coil terminal 44.

The one end portion of the fifth discharge electrode is electrically connected to a ground wiring line of the mounting substrate via the first ground terminal 51. The other end portion of the fifth discharge electrode 35 is electrically connected to a ground wiring line of the mounting substrate via the second ground terminal 52.

Since the electronic component 10H includes the electrostatic discharge element 3, countermeasures against static electricity can be taken for the first coils 211 and 212 and the second coils 221 and 222. That is, an ESD is generated by the electrostatic discharge element 3, and the ESD can be distributed to ground via the first and second ground terminals 51 and 52 and an ESD voltage flowing to a signal line can be reduced.

The present disclosure is not limited to the above-described embodiments and design changes can be made within a range that does not depart from the gist of the present disclosure. For example, the characteristic features of the first to ninth embodiments may be combined with each other in various ways. For example, the fifth embodiment may be combined with the second embodiment. More specifically, in the second embodiment, the multilayer body may include a non-magnetic body and upper and lower magnetic bodies, the first and second coils may be arranged inside the non-magnetic body and the outer ground electrode may be arranged inside one of the magnetic bodies.

In the above-described embodiments, there are two of each of the first coils and the second coils, but there may instead be three or more.

In the above-described embodiments, regarding the arrangement of the first coils and second coils, the coils are arranged in the order of second coil, first coil, first coil, second coil when looking from above, but the coils may instead be arranged in the order of first coil, first coil, second coil, second coil. At this time, the inner ground electrode may be arranged between the two first coils and the two second coils.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An electronic component comprising:

a multilayer body that includes a plurality of insulating layers that are stacked on top of one another;

a plurality of first coils that are arranged inside the multilayer body in a stacking direction of the multilayer body and are electrically connected to each other;

a plurality of second coils that are arranged inside the multilayer body in the stacking direction of the multilayer body and are electrically connected to each other;

an inner ground electrode that is provided inside the multilayer body and is arranged between two of the first coils that face each other in the stacking direction;

a first ground terminal that is provided on a first side surface of the multilayer body, the first ground terminal being electrically connected to the inner ground electrode, a second ground terminal that is provided on a third side surface of the multilayer body opposite to the first side surface, the second ground terminal being electrically connected to the inner ground electrode, a first coil terminal that is provided on a second side surface of the multilayer body that is adjacent to the first and third side surfaces, the first coil terminal being electrically connected to the plurality of first coils, a second coil terminal that is provided on the second side surface, the second coil terminal being electrically connected to the plurality of second coils, a third coil terminal that is provided on a fourth side surface of the multilayer body opposite to the second side surface, the third coil terminal being electrically connected to the plurality of first coils, and a fourth coil terminal that is provided on the fourth side surface, the fourth coil terminal being electrically connected to the plurality of second coils, wherein two of the first coils are electrically connected to each other by a via conductor provided in an inner part of the inner ground electrode, each of the plurality of insulating layers are non-magnetic, and each of the plurality of first coils is arranged in a different insulating layer than each of the plurality of second coils.

2. The electronic component according to claim 1, further comprising:

an electrostatic discharge element that is provided in the multilayer body, is connected to the first and second coils and is connected to the ground terminal.

3. The electronic component according to claim 1, wherein at least one of the second coils is arranged at at least one of an uppermost position and a lowermost position among the plurality of first and second coils in the stacking direction, and an outer ground electrode, which faces the at least one of the second coils, is provided outside of the at least one of the second coils in the stacking direction.

4. The electronic component according to claim 3, wherein the second coils are arranged at both the uppermost position and the lowermost position among the plurality of first and second coils in the stacking direction, and the outer ground electrode is provided in a plurality and the outer ground electrodes are arranged outside both the second coils.

5. The electronic component according to claim 3, wherein there are two of each of the first and second coils, and the two first coils are interposed between one of the second coils and another of the second coils.

6. The electronic component according to claim 3, wherein the multilayer body includes a non-magnetic body and magnetic bodies that vertically sandwich the non-magnetic body therebetween in the stacking direction, the first and second coils are arranged inside the non-magnetic body, and the one or more outer ground electrodes are arranged inside the non-magnetic body.

7. The electronic component according to claim 3, wherein the multilayer body includes a non-magnetic body and magnetic bodies that vertically sandwich the non-magnetic body therebetween in the stacking direction, the first and second coils are arranged inside the non-magnetic body, and the one or more outer ground electrodes are arranged inside the magnetic bodies.

8. The electronic component according to claim 3, wherein a surface area of each of the one or more outer ground electrodes when looking in the stacking direction is larger than a surface area of the inner ground electrode when looking in the stacking direction.

9. The electronic component according to claim 8, wherein the inner and outer ground electrodes are each formed in a substantially spiral shape, and a length of the spiral shape of each of the one or more outer ground electrodes is longer than a length of the spiral shape of the inner ground electrode.

10. The electronic component according to claim 3, wherein the inner ground electrode is superposed with the first coils, which face the inner ground electrode, and is not superposed with inner diameter parts of the first coils, which face the inner ground electrode, when viewed in the stacking direction, and the one or more outer ground electrodes are superposed with the second coils, which face the one or more outer ground electrodes, and are not superposed with inner diameter parts of the second coils, which face the one or more outer ground electrodes, when viewed in the stacking direction.

11. The electronic component according to claim 10, wherein the inner ground electrode has a substantially spiral shape that has a line width and a line separation that are substantially the same as those of the first coils, which face the inner ground electrode, and is arranged at such a position as to be superposed with a pattern of the first coils when viewed in the stacking direction, and the one or more outer ground electrodes have a substantially spiral shape that has a line width and a line separation that are substantially the same as those of the second coils, which face the one or more outer ground electrodes, and are arranged at such a position as to be superposed with a pattern of the second coils when viewed in the stacking direction.

* * * * *